US008097124B2

(12) United States Patent
Hamers et al.

(10) Patent No.: US 8,097,124 B2
(45) Date of Patent: Jan. 17, 2012

(54) AQUEOUS ALKYLKETENE DIMER DISPERSIONS

(75) Inventors: Christoph Hamers, Ludwigshafen (DE); Andreas Brockmeyer, Bickenbach (DE); Markus Schmid, Deidesheim (DE); Klaus Lorenz, Worms (DE); Ulrich Riebeling, Schifferstadt (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 436 days.

(21) Appl. No.: 12/303,253

(22) PCT Filed: Jun. 1, 2007

(86) PCT No.: PCT/EP2007/055372

§ 371 (c)(1), (2), (4) Date: Dec. 3, 2008

(87) PCT Pub. No.: WO2007/141197

PCT Pub. Date: Dec. 13, 2007

(65) Prior Publication Data

US 2009/0139677 A1 Jun. 4, 2009

(30) Foreign Application Priority Data

Jun. 9, 2006 (EP) ..... 06115218

(51) Int. Cl.
*D21F 11/00* (2006.01)

(52) U.S. Cl. ..... 162/158

(58) Field of Classification Search ..... 252/363.5; 162/175, 158

See application file for complete search history.

(56) References Cited

U.S. PATENT DOCUMENTS

| | | | | |
|---|---|---|---|---|
| 4,240,935 | A | 12/1980 | Dumas | |
| 4,861,376 | A * | 8/1989 | Edwards et al. | 106/209.1 |
| 5,154,763 | A | 10/1992 | Ksoll et al. | |
| 6,162,328 | A | 12/2000 | Cenisio et al. | |
| 6,268,414 | B1 * | 7/2001 | Lin | 524/72 |
| 6,669,816 | B1 | 12/2003 | Poch et al. | |
| 2008/0041546 | A1 | 2/2008 | Schmid et al. | |

FOREIGN PATENT DOCUMENTS

| | | | |
|---|---|---|---|
| DE | 10 2004 002 370 | A1 | 8/2005 |
| EP | 0 369 328 | | 5/1990 |
| EP | 0 369 328 | A2 | 5/1990 |
| EP | 0 437 764 | A1 | 7/1991 |
| WO | WO 01/18311 | A1 | 3/2001 |
| WO | WO 2004/022851 | A1 | 3/2004 |
| WO | WO 2006/058711 | A2 | 6/2006 |

OTHER PUBLICATIONS

Notice of EPO Opposition dated Jul. 14, 2010, in Patent No. 2 032 759.

* cited by examiner

*Primary Examiner* — Mark Halpern

(74) *Attorney, Agent, or Firm* — Oblon, Spivak, McClelland, Maier & Neustadt, L.L.P.

(57) ABSTRACT

Aqueous alkyl ketene dimer dispersions which comprise at least 15% by weight of an alkyl ketene dimer and at least one water-soluble cationic starch, aluminum sulfate and at least one condensate of naphthalenesulfonic acid and formaldehyde or lignin sulfonic acid or in each case salts thereof, the dispersions comprising, based in each case on alkyl ketene dimer, from 2 to 50% by weight of aluminum sulfate, and in which the dispersions additionally comprise from 0.1 to 5% by weight of a saturated carboxylic acid having 1 to 10 carbon atoms, benzenesulfonic acid, p-toluenesulfonic acid and/or a mineral acid at an aluminum sulfate content of from 2 to 15% by weight, and the use of the dispersions as engine size and surface size for paper and paper products.

22 Claims, No Drawings

AQUEOUS ALKYLKETENE DIMER DISPERSIONS

This application is a 371 of PCT/EP2007/055372 filed on 1 Jun. 2006

The invention relates to aqueous alkyl ketene dimer dispersions which comprise at least 15% by weight of an alkyl ketene dimer and at least one water-soluble cationic starch, aluminum sulfate and at least one condensate of naphthalene sulfonic acid and formaldehyde or lignin sulfonic acid or in each case salts thereof.

Aqueous dispersions of alkyl ketene dimers (AKD) are commercial products. They are used for making paper and cardboard water repellent. Aqueous alkyl ketene dispersions usually comprise cationic starch and sodium lignin sulfonates as stabilizers. The term dispersion relates to a 2-phase system which comprises solid particles in a liquid phase as the continuous medium. The term emulsion is understood as meaning a 2-phase system which comprises liquid drops emulsified in a further liquid phase.

The alkyl ketene dimers used as water repellent have a melting point of about 45-70° C. Mixtures of alkyl ketene dimers and water are therefore dispersions at temperatures below 40° C. and emulsions at temperatures above 45° C. In order to use alkyl ketene dimer dispersions as sizes in the production of paper and cardboard, it is necessary for the dispersions to be dilutable and stable to pumping and have a shelf-life of several weeks at temperatures up to 32° C.

U.S. Pat. No. 4,240,935 discloses aqueous alkyl ketene dimer dispersions which comprise, as stabilizers, epichlorohydrin resins, sodium lignin sulfonates and/or a condensate of the sodium salt of naphthalene sulfonic acid and formaldehyde. The solids content of the aqueous dispersions is from 5 to 25% by weight, the ratio of alkyl ketene dimer to epichlorohydrin resins being in the range from 4:1 to 1:3.

EP-A 369 328 discloses alkyl ketene dimer dispersions having a solids content of up to 30% by weight. They comprise, as stabilizers, based in each case on alkyl ketene dimer, from 0.15 to 1.5% by weight of aluminum sulfate, from 0.1 to 5% by weight of a carboxylic acid having 1 to 10 carbon atoms, from 10 to 30% by weight of a cationic starch and from 1 to 5% by weight of a salt of lignin sulfonic acid or a condensate of formaldehyde and a salt of naphthalene sulfonic acid, the viscosity of these dispersions increasing by less than 100 centistokes after storage for four weeks at a temperature of 32° C.

In recent years, there has been a trend toward containers based on board for consumable liquids, in particular milk and cream. The walls of such containers are usually coated on two sides, sometimes only on one side, with polyethylene.

For these containers based on board and intended for consumable liquids to meet the requirements, they must be resistant to the action of lactic acid so that the lactic acid does not penetrate through the cardboard at critical points of the container, for example the interfaces at least to be bonded to one another. In addition, the containers must be disinfected with hot hydrogen peroxide before they are filled with consumable liquids. This means that the containers withstand the action of hot hydrogen peroxide. Edge penetration of lactic acid and hot hydrogen peroxide solution are therefore decisive properties of containers in which consumable liquids are packed.

WO 2004/022851 discloses, for the production of packagings of liquids, the use of a cardboard which is obtainable by engine sizing of a paper stock comprising an aqueous slurry of cellulose fibers with at least one engine size in the presence of at least one retention aid and a cationic polymer, such as polyvinylamine. Engine sizes used are, for example, aqueous dispersions of alkyl ketene dimers and/or rosin, which in each case are emulsified with the aid of cationic starch. Aluminum compounds are used virtually only together with rosin.

DE-A 10 2004 002 370 discloses a packaging material comprising at least one two-layer composite of sized paper or sized cardboard and at least one water-impermeable film for the production of containers for the packaging of liquids. The paper or the cardboard comprises a finely divided water-insoluble or water-soluble synthetic polymer having a mean particle size of from 1 μm to 1000 μm.

It is the object of the invention to provide a further alkyl ketene dimer dispersion which has a long shelf-life and is stable to shearing. In addition, when used for the production of cardboard for the packaging of liquids, the dispersion should lead to containers which show an improvement regarding the edge penetration, in particular the hydrogen peroxide edge penetration, compared with products sized with known dispersions.

The object is achieved, according to the invention, by aqueous alkyl ketene dimer dispersions which comprise at least 15% by weight of an alkyl ketene dimer and at least one water-soluble cationic starch, aluminum sulfate and at least one condensate of naphthalene sulfonic acid and formaldehyde or lignin sulfonic acid or in each case salts thereof, if the dispersions comprise, based in each case on alkyl ketene dimer, from 2 to 50% by weight of aluminum sulfate, the dispersions additionally comprising from 0.1 to 5% by weight of a saturated carboxylic acid having 1 to 10 carbon atoms, benzene sulfonic acid, p-toluenesulfonic acid and/or a mineral acid at an aluminum sulfate content of from 2 to 15% by weight.

The aqueous alkyl ketene dimer dispersions preferably comprise, based on alkyl ketene dimer, from 5 to 30% by weight of aluminum sulfate. Those alkyl ketene dimer dispersions which comprise, based on alkyl ketene dimer, from 10 to 20% by weight of aluminum sulfate are particularly preferred.

For example, the aqueous alkyl ketene dimer dispersions comprise, based in each case on alkyl ketene dimer, (a) from 5 to 30% by weight of aluminum sulfate,
(b) from 10 to 30% by weight of at least one water-soluble cationic starch,
(c) from 1 to 5% by weight of at least one condensate of naphthalene sulfonic acid and formaldehyde or of a salt of naphthalene sulfonic acid and formaldehyde and/or lignin sulfonic acid or a salt of lignin sulfonic acid and
(d) from 0 to 5% by weight of at least one saturated carboxylic acid having 1 to 10 carbon atoms, benzene sulfonic acid, p-toluene sulfonic acid and/or a mineral acid.

At a content of from 2 to 15% by weight of aluminum sulfate, based on alkyl ketene dimer, the dispersions additionally comprise from 0.1 to 5% by weight of a saturated carboxylic acid having 1 to 10 carbon atoms, benzenesulfonic acid, p-toluenesulfonic acid and/or a mineral acid.

Particularly preferred aqueous alkyl ketene dimer dispersions are those which comprise from 15 to 30% by weight of at least one alkyl ketene dimer and, based in each case on alkyl ketene dimers, (a) from 10 to 20% by weight of aluminum sulfate,
(b) from 15 to 25% by weight of at least one water-soluble cationic starch,
(c) from 1.8 to 4.0% by weight of at least one condensate of naphthalene sulfonic acid and formaldehyde or of a salt of naphthalene sulfonic acid and formaldehyde and/or lignin sulfonic acid or a salt of lignin sulfonic acid,
(d) from 0 to 5% by weight of at least one saturated carboxylic acid having 1 to 10 carbon atoms.

Alkyl ketene dimers can be characterized, for example, with the aid of the general formula

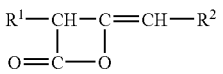

(I)

where the substituents $R^1$ and $R^2$ are a $C_8$- to $C_{30}$-hydrocarbon radical which may be saturated or unsaturated, linear or branched. The substituents $R^1$ and $R^2$ comprise, for example, the following radicals: octyl, decyl, dodecyl, tetradecyl, hexadecyl, octadecyl, eicosyl, docosyl, tetracosyl, phenyl, benzyl, β-naphthyl and cyclohexyl.

The preferred alkyl ketene dimers comprise, as $R^1$ and $R^2$, saturated and mono- or polyunsaturated and branched hydrocarbon compounds having 12 to 20, preferably 14 to 18, carbon atoms.

The compounds of the formula I are prepared, for example, by reacting carboxylic acid chlorides with tertiary amines. Of industrial importance are in particular carboxylic acid chlorides which are obtainable by chlorination of naturally occurring fatty acids or mixtures thereof, for example acid chlorides based on fatty acids which are obtained from coconut oil, tall oil, castor oil, olive oil, beef tallow or palm kernel oil. Typical examples of carboxylic acid chlorides are myristoyl chloride, palmitoyl chloride, stearoyl chloride, oleoyl chloride, behenoyl chloride and isostearoyl chloride. Reaction of the carboxylic acid chlorides with the tertiary amines is particularly advantageously carried out in the absence of solvents with intensive mixing at temperatures of from 65 to 150° C. by the process disclosed in EP-A 1 453 821.

The aqueous dispersions comprise at least 15% by weight to 30% by weight of alkyl ketene dimer, preferably from 15 to 25% % by weight of alkyl ketene dimer.

The aqueous alkyl ketene dimer dispersions according to the invention are stabilized with the aid of cationic starch. Suitable cationic starch comprises all water-soluble starches which have an amino group as the cationic group. Such starches are commercial products. They are obtained, for example, by reacting native starch with compounds which have tertiary or quaternary nitrogen atoms, such as dialkylaminoalkyl epoxides or dialkylaminoalkyl chlorides. Examples of such compounds are 3-chloro-2-hydroxypropyltrimethylammonium chloride and glycidyltrimethylammonium chloride. The degree of cationization of the starch is specified, for example, with the aid of the degree of substitution (D.S.). This value shows the number of cationic groups per monosaccharide unit in the cationic starch. The degree of substitution D.S. of the cationic starch is preferably from 0.01 to 0.5 and is in general in the range from 0.02 to 0.4. A cationic starch is also obtainable by first subjecting a native starch to enzymatic degradation and then cationizing the degraded starch. Starches having said degree of substitution D.S. have a sufficient number of cationic groups so that they are positively charged in aqueous solution.

For example, starches from potatoes, tapioca, rice, wheat, corn, sorghum and peas are suitable as a basis for cationic starches. The amylopectin content of the starches may be, for example, from 0.1 to 100%. An example of a water-soluble cationic starch is Percole® 134 EP having a degree of substitution D.S. of 0.17. Preferably used cationic starches have a degree of substitution D.S. of at least 0.08. Cationic potato starch which is modified with a tertiary or with a quaternary amine and has a viscosity of from 50 to 200 mPas (measured in a Brookfield viscometer at a temperature of 20° C., spindle 2, at a solids content of 3.0%) is particularly preferred.

The aqueous alkyl ketene dimer dispersions usually comprise from 10 to 30% by weight, preferably from 15 to 25% by weight, of at least one cationic starch. They are positively charged and have a positive overall charge even in the presence of the other dispersion stabilizers.

The aqueous alkyl ketene dimer dispersions comprise, according to the invention, from 2 to 50% by weight, based on alkyl ketene dimer, of aluminum sulfate. In general, the content of aluminum sulfate, based in each case on alkyl ketene dimer, in the aqueous dispersions is from 5 to 30% by weight, in particular from 10 to 20% by weight.

The aqueous alkyl ketene dimer dispersions comprise, as further stabilizer, at least one condensate of naphthalene sulfonic acid and formaldehyde or a condensate of a salt of naphthalene sulfonic acid and formaldehyde and/or lignin sulfonic acid or a salt of lignin sulfonic acid. Suitable salts of naphthalene sulfonic acid and of lignin sulfonic acid are, for example, the alkali metal, ammonium and alkaline earth metal salts, such as, in particular, the ammonium, calcium, magnesium, potassium and sodium salts. The sodium salts of lignin sulfonate or of condensates of the sodium salt of naphthalene sulfonic acid and formaldehyde are particularly preferably used as a dispersion stabilizer.

The dispersion stabilizers comprising sulfo or sulfonate groups are used, for example, in amounts of from 1 to 5, preferably from 1.8 to 4% by weight, based on alkyl ketene dimer.

The aqueous alkyl ketene dimer dispersions according to the invention additionally comprise from 0.1 to 5% by weight, based on alkyl ketene dimer, of a saturated carboxylic acid having 1 to 10 carbon atoms, benzene sulfonic acid, p-toluenesulfonic acid and/or a mineral acid at an aluminum sulfate content of from 2 to 15% by weight, based on alkyl ketene dimer. In the case of larger amounts of aluminum sulfate, the aqueous alkyl ketene dimer dispersions can, if appropriate, additionally comprise a further acid. Suitable further acids are preferably carboxylic acids having 1 to 10 carbon atoms, e.g. formic acid, acetic acid, propionic acid, lactic acid, salicylic acid, maleic acid, fumaric acid, benzoic acid, citric acid, adipic acid and phthalic acid.

The pH of the aqueous alkyl ketene dimer dispersions is, for example, from 2.0 to 4.0.

The aqueous alkyl ketene dimer dispersions described above are used as engine size and surface size for paper and paper products. Paper products are to be understood as meaning both board and cardboard. In the production of paper and paper products, cellulose fibers of all types, both natural and reclaimed fibers, in particular fibers from wastepaper, can be used as starting materials. Suitable fibers for the production of the pulps are all qualities customary for this purpose, i.e. mechanical pulp, bleached and unbleached chemical pulp and paper stocks comprising all annual plants. Mechanical pulp includes, for example, groundwood, thermomechanical pulp (TMP), chemothermomechanical pulp (CTMP), pressure groundwood, semichemical pulp, high-yield pulp and refiner mechanical pulp (RMP). For example, sulfate, sulfite and soda pulps are suitable as chemical pulp. Preferably, unbleached pulp, which is also referred to as unbleached kraft pulp, is used. Suitable annual plants for the production of paper stocks are, for example, rice, wheat, sugarcane and kenaf. For the production of the pulps, it may also be advantageous to use wastepaper, which is employed either alone or as a mixture with other fibers, or fiber mixtures comprising a primary stock and recycled coated waste, e.g. bleached pine sulfate as a mixture with recycled coated waste, can be used as starting material.

The aqueous alkyl ketene dimer dispersions according to the invention can be used in the production of paper and paper products together with the customary process chemicals, such as retention aids, flocculants and drainage aids, fixing compositions, wet and dry strength agents, biocides, dyes, alkenylsuccinic anhydrides and rosin. Alkyl ketene dimers emulsified according to the invention are stable to shearing and have a shelf-life. They can be stored, for example, for more than three months.

The aqueous alkyl ketene dimer dispersions according to the invention are preferably used as engine size in the production of paper and paper products.

They are used, for example, for the production of writing and printing papers and are particularly advantageously used in the production of containers for the packaging of liquids. For example, a pulp may comprise from 0.01 to 0.6% by weight, based on the dry content of the pulp, of an alkyl ketene dimer. After drainage of the paper stock and drying of the paper or of the paper products, engine-sized products having a basis weight of, for example, from 40 to 400 g/m$^2$ are obtained. Board which is used for the production of containers for consumable liquids has, for example, a basis weight of from 100 to 300 g/m$^2$. The amount of alkyl ketene dimer used for sizing paper or paper products is, for example, from 0.05 to 4.0, preferably from 0.15 to 0.8% by weight, based on dry paper stock.

For the production of containers for the packaging of liquids, for example, the engine-sized paper product is laminated on one or both sides with a film comprising a plastic or metal, such as aluminum. Suitable plastics films may be produced from polyethylene, polypropylene, polyamide or polyester. The films may be bonded to the sized paper products, for example, with the aid of an adhesive. In general, films which are coated with an adhesive are used for this purpose; they are applied to one or both sides of a paper product and the composite is then pressed. However, it is also possible to coat the surface of the sized paper products with an adhesive, and then to apply the films and thereafter to press the composite. Thermoplastic films can, however, also be processed directly by the action of heat and pressure with the engine-sized paper product to give a composite whose suitable blanks for the production of containers for the packaging of liquids are then produced. Such packaging is preferably used in the food sector, for example for the packaging of beverages, such as mineral water, juices or milk, or for the production of drinking vessels, such as cups. In the case of this packaging, what is important is that it has good values for the edge penetration, i.e. the sized paper product should absorb as little liquid as possible or virtually none. The cut edges of such containers must have high resistance to the penetration of hot hydrogen peroxide and lactic acid.

The containers produced using the alkyl ketene dimer dispersions according to the invention and intended for liquid packaging have improved values for the hydrogen peroxide edge penetration in combination with very good values for the lactic acid edge penetration compared with containers which were sized with known alkyl ketene dimer dispersions.

Unless otherwise evident from the context, the stated percentages in the examples are percent by weight.

EXAMPLES

Example 1

A batch of 1000 g in total comprised the following constituents:

200 g of $C_{16}/C_{18}$-alkyl diketene
30 g of cationic starch (Perlcole® 134 EP)
7.5 g of sodium lignin sulfonate (Tamol® 2901)
700 g of water
49 g of aluminum sulfate
13.5 g of residual water Preparation of the Aqueous Alkyl Ketene Dimer Dispersion 30 g of cationic starch (commercially available under Pericol® 134 EP, Lyckeby) and 7.5 g of sodium lignin sulfonate (commercially available under Tamol® 2901, BASF AG.) were added to 700 g of water. The mixture was heated to 95° C. and water (13.5 g) was subsequently added. After the mixture had been cooled to 80° C., 200 g of a mixture of $C_{16}/C_{18}$-alkyl diketene (Basoplast® BP 90 Conc) were added. After the alkyl diketene had melted, the temperature of the mixture was about 70° C. The mixture was homogenized by a high-pressure homogenizer (model APV-Lab 60) at a pressure of 170 bar in two passes. 49 g of aluminum sulfate were then added to the warm emulsion. The pH of the alkyl diketene dispersion was adjusted to 3.6 by addition of 0.1 M HCl. The solids content of the dispersion was 28%.

The alkyl diketene dispersion had a viscosity of 100 mPas (measured in a Brookfield viscometer, spindle 2, 20° C.) after storage for 5 weeks at a temperature of 32° C.

Comparative Example 1

Reworking of Example 2 of EP-A 0 369 328

A batch of 500 g in total comprised the following constituents:

100 g of $C_{16}/C_{18}$-alkyl diketene
22.5 g of cationic starch (Amaizo® 2187)
2 g of sodium lignin sulfonate (Lignasol® XD)
368.4 g of 0.01 M acetic acid
0.33 g of aluminum sulfate (5% strength in water)
water to 500 g.

Preparation of the Aqueous Alkyl Ketene Dimer Dispersion 22.5 g of cationic starch (commercially available under Amaizo® 2187) and 2 g of sodium lignin sulfonate (commercially available under Lignasol® XD) were added to 368.4 g of 0.01 M acetic acid. The pH was adjusted to pH 5.5 by means of 0.1 M hydrochloric acid. The mixture was heated to 95° C. and water (15 g) was subsequently added. After the mixture had been cooled to 80° C., 100 g of a mixture of $C_{16}/C_{18}$-alkyl diketenes (Basoplast® BP 90 Conc) were added. After the AKD had melted, the temperature of the mixture was 65° C. The mixture was then homogenized by a high-pressure homogenizer (model APV-Lab 60) at a pressure of 170 bar in one pass. 0.33 g of a 5% strength aluminum sulfate solution was then added to the warm emulsion. The pH of the dispersion was adjusted to 3.6 by addition of 0.1 M hydrochloric acid. The solids content was 25%.

The dispersion had a viscosity of 120 mPas (measured in a Brookfield viscometer, spindle 2, 20° C.) after storage for 5 weeks at 32° C.

Determination of the Edge Penetration for Consumable Beverage Liquid Cardboards

For each layer of a cardboard, in each case a 120 g/m$^2$ sheet was produced on a laboratory sheet former with the use of the sizes stated in table 1 and 0.15% of Polymin® 215 as a retention aid and then dried by contact cylinder drying at 120° C. in 5 passes. Table 2 states the values determined for the edge penetration of hydrogen peroxide.

The top layer of the cardboard consisted of chemical pulp comprising 70% of bleached short fibers and 30% of bleached long fibers.

The middle layer of the cardboard consisted of chemical pulp comprising 60% of CTMP and 40% of coated waste.

The substrate of the cardboard consisted of 100% of unbleached chemical pulp.

TABLE 1

| | AKD size | | |
|---|---|---|---|
| | [%] | prepared according to | Layer |
| Example no. | | | |
| 2 | 0.20% | example 1 | top |
| 3 | 0.20% | example 1 | middle |
| 4 | 0.20% | example 1 | bottom |
| Comparative example no. | | | |
| 2 | 0.20% | comparative example 1 | top |
| 3 | 0.20% | comparative example 1 | middle |
| 4 | 0.20% | comparative example 1 | bottom |

After the cardboard had been produced, the edge penetration for hydrogen peroxide and lactic acid was determined by the following methods:

(a) determination of the sheet weight
(b) halving of the sheets
(c) adhesive bonding of the sheets
(d) cutting of the sheets into 25×75 mm strips
(e) determination of the thickness of the strips Re a): Determination of the Sheet Weight The conditioned sheets are weighed (accuracy 1 mg) and the weight is then converted into g/m$^2$.

Re b): The Conditioned Sheets are Halved with the Aid of a Sheet Cutter.

Re c): Adhesive Bonding of the Sheets

A laboratory size press with parts provided for this purpose which fix the adhesive tape rolls is converted, it being ensured that adhesive tape adhesively bonds exactly to one another, i.e. the adhesive surfaces do not come into contact with the rolls. The speed of the size press was 2.2 m/min and the contact pressure was 4 bar. To prevent creasing, the halved sheets are shortened by about 1-1.5 cm on the round side. The adhesively bonded sheets were then cut with scissors.

Re d): Cut Adhesively Bonded Sheets into Test Strips

25×75 mm strips were cut out of the adhesively bonded sheets. It should be ensured here that the strips are covered on both sides completely with adhesive film, that there are creases in the cut areas and that the edges are exact and clean. The strips are then inscribed and bundled. In addition, the blade and the cutting edge of the sheet cutter must be cleaned from time to time with acetone to remove adhesive tape residues, in order to prevent clogging of the sheet edge.

Re e): Thickness Determination

The thickness of the adhesively bonded and cut sheets was measured (0.001 mm accuracy). The thickness of the adhesive tape was then subtracted in order to determine the net thickness. The sheets were each measured after adhesive bonding because they then had better homogeneity.

Peroxide Test

The peroxide was thermostated in metal dishes by means of a water bath at 70° C. The samples were weighed in the dry state, placed in the peroxide bath for 10 minutes, weighted with a grid in order to ensure that they did not float, then removed, adhering peroxide was taken up with filter paper and reweighing was immediately effected in the moist state.

Lactic Acid Test

Differs from the peroxide test only in that 1% strength lactic acid was used as the test liquid. The measurements were carried out at room temperature and the action time was 1 hour.

The calculation was effected according to the following formulae:

$$\frac{X \cdot W_0 \cdot 1000}{n \cdot W \cdot 2(a+b)} = \text{edge absorption [g/m]}$$

$$\frac{\text{Edge absorption [g/m]} \cdot 1000}{t} = \text{edge absorption [kg/m}^2\text{]}$$

X=sum of the weight difference of all strips (moist weight−dry weight) [g]
$W_0$=required weight per unit area [g/m$^2$]
W=actual weight per unit area [g/m$^2$]
n=number of test strips
a=length of the strips [mm]
b=width of the strips [mm]
t=thickness of the strips [μm]

The results of the edge penetration for hydrogen peroxide are listed in table 2.

TABLE 2

| Cardboard layer from | H2O2 edge penetration [kg/m2] | Layer |
|---|---|---|
| Example 2 | 0.56 | Top |
| Comparative example 2 | 1.2 | Top |
| Example 3 | 1.46 | Middle |
| Comparative example 3 | 2.1 | Middle |
| Example 4 | 1.34 | Bottom |
| Comparative example 4 | 0.99 | Bottom |

In comparison with the comparative examples, the AKD dispersion according to the invention shows a substantial improvement in the values for the hydrogen peroxide penetration. In the case of the lactic acid edge penetration, on the other hand, only a slight improvement of the AKD dispersion according to the invention compared with the comparative dispersion was evident.

We claim:

1. An aqueous dispersion comprising:

at least 15 wt. % of at least one alkyl ketene dimer, based on a total weight of the aqueous dispersion, wherein the aqueous dispersion further comprises, based on a total weight of the alkyl ketene dimer:

2-50 wt. % of aluminum sulfate;

at least one water soluble cationic starch;

at least one stabilizer selected from the group consisting of a condensate of naphthalene sulfonic acid and formaldehyde, a condensate of a salt of naphthalene sulfonic acid and formaldehyde, lignin sulfonic acid, a salt of lignin sulfonic acid, and mixtures thereof; and 0.1-5 wt. % of benzene sulfonic acid and/or p-toluene sulfonic acid.

2. The aqueous dispersion according to claim 1, which comprises 15-30 wt. % of the alkyl ketene dimer, based on the total weight of the aqueous dispersion.

3. The aqueous dispersion according to claim 1, which comprises 15-25 wt. % of the alkyl ketene dimer, based on the total weight of the aqueous dispersion.

4. The aqueous dispersion according to claim 1, wherein the alkyl ketene dimer is at least one compound represented by the following general formula (I):

(I)

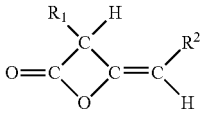

wherein $R^1$ and $R^2$ are each independently a saturated or unsaturated, linear or branched, $C_8$-$C_{30}$ hydrocarbon radical.

5. The aqueous dispersion according to claim 1, which comprises, based on the total weight of the alkyl ketene dimer, 5-50 wt. % of aluminum sulfate.

6. The aqueous dispersion according to claim 1, which comprises, based on the total weight of the alkyl ketene dimer, 10-50 wt. % of aluminum sulfate.

7. The aqueous dispersion according to claim 1, which comprises, based on the total weight of the alkyl ketene dimer, 20-50 wt. % of aluminum sulfate.

8. The aqueous dispersion according to claim 1, which comprises, based on the total weight of the alkyl ketene dimer, 30-50 wt. % of aluminum sulfate.

9. The aqueous dispersion according to claim 1, which comprises, based on the total weight of the alkyl ketene dimer, 5-30 wt. % of aluminum sulfate.

10. The aqueous dispersion according to claim 1, which comprises, based on the total weight of the alkyl ketene dimer, 10-20 wt. % of aluminum sulfate.

11. The aqueous dispersion according to claim 1, which comprises, based on the total weight of the alkyl ketene dimer, 10-30 wt. % of the water soluble cationic starch.

12. The aqueous dispersion according to claim 1, which comprises, based on the total weight of the alkyl ketene dimer, 1-5 wt. % of the stabilizer.

13. The aqueous dispersion according to claim 1, wherein the stabilizer is the condensate of naphthalene sulfonic acid and formaldehyde, or the condensate of a salt of naphthalene sulfonic acid and formaldehyde.

14. The aqueous dispersion according to claim 1, wherein the stabilizer is lignin sulfonic acid, or a salt of lignin sulfonic acid.

15. The aqueous dispersion according to claim 1, which comprises, based on the total weight of the alkyl ketene dimer, 0.1-5 wt. % of benzene sulfonic acid.

16. The aqueous dispersion according to claim 1, which comprises, based on the total weight of the alkyl ketene dimer, 0.1-5 wt. % of p-toluene sulfonic acid.

17. The aqueous dispersion according to claim 1, which comprises, based on the total weight of the alkyl ketene dimer, 0.1-5 wt. % of benzene sulfonic acid and p-toluene sulfonic acid.

18. The aqueous dispersion according to claim 1, which comprises:

at least 15 wt. % of the alkyl ketene dimer, based on the total weight of the aqueous dispersion, wherein the aqueous dispersion further comprises, based on the total weight of the alkyl ketene dimer:

5-30 wt. % of aluminum sulfate;

10-30 wt. % of the water soluble cationic starch;

1-5 wt. % of the stabilizer; and 0.1-5 wt. % of benzene sulfonic acid and/or p-toluene sulfonic acid.

19. The aqueous dispersion according to claim 18, which comprises 15-30 wt. % of the alkyl ketene dimer, based on the total weight of the aqueous dispersion.

20. The aqueous dispersion according to claim 18, which comprises 15-25 wt. % of the alkyl ketene dimer, based on the total weight of the aqueous dispersion.

21. The aqueous dispersion according to claim 1, which comprises:

15-30 wt. % of the alkyl ketene dimer, based on the total weight of the aqueous dispersion, wherein the aqueous dispersion further comprises, based on the total weight of the alkyl ketene dimer:

10-20 wt. % of aluminum sulfate;

15-25 wt. % of the water soluble cationic starch;

8-4.0 wt. % of the stabilizer; and 0.1-5 wt. % of benzene sulfonic acid and/or p-toluene sulfonic acid.

22. The aqueous dispersion according to claim 21, which comprises 15-25 wt. % of the alkyl ketene dimer, based on the total weight of the aqueous dispersion.

* * * * *